United States Patent [19]

Birkle et al.

[11] Patent Number: 4,671,862

[45] Date of Patent: Jun. 9, 1987

[54] APPARATUS FOR MASS ELECTROPLATING OF BULK GOODS

[75] Inventors: Siegfried Birkle, Höchstadt/Aisch; Johann Gehring, Spardorf, both of Fed. Rep. of Germany

[73] Assignee: Siemens Aktiengesellschaft, Berlin and Munich, Fed. Rep. of Germany

[21] Appl. No.: 906,038

[22] Filed: Sep. 11, 1986

[30] Foreign Application Priority Data

Sep. 17, 1985 [DE] Fed. Rep. of Germany ..... 3533151

[51] Int. Cl.[4] ..... C25D 17/16

[52] U.S. Cl. ..... 204/213

[58] Field of Search ..... 204/212, 213, 214, 275

[56] References Cited

U.S. PATENT DOCUMENTS 4,360,409 11/1982 Stoeger ..... 204/213

FOREIGN PATENT DOCUMENTS 830862 2/1952 Fed. Rep. of Germany ..... 204/213

*Primary Examiner*—T. M. Tufariello

*Attorney, Agent, or Firm*—Hill, Van Santen, Steadman & Simpson

[57] ABSTRACT

An apparatus for the mass electroplating of bulk goods includes a plating tank for the acceptance of the electrolyte, a goods carrying dish being mounted in the tank for rotation around an inclined axis with the dish being immersed in the electrolyte and at least one anode immersed in the electrolyte with the dish having at least one dog for spreading the goods on the floor of the dish and having at least one sliding door provided on the periphery of the dish to enable discharge of the goods therefrom. The dog can be in the form of ribs which can subdivide the dish into various compartments such as radially extending segments with each of the segments having a discharge door or the dog can be formed as a helical track. Preferably, the plating tank is a closable gas tight tank, which is provided with admission and discharge locks so that the mass aluminization utilizing an aprotic, oxygen-free and water-free, aluminum-organic electrolyte can occur.

25 Claims, 4 Drawing Figures

Sch
S
100
R
G
B1
R
Bb
Wa
W1
Sch

100
Es
Bb
Es
Fr
Dp1
G
Ac
B1
K
Le
A1
D
W1
Lg
Aw
Sch
U
Be
α
Vz
Wa
Da
Dp2
Ao1
As
Ge
Ao2

APPARATUS FOR MASS ELECTROPLATING OF BULK GOODS

BACKGROUND OF THE INVENTION

The present invention is directed to an apparatus for the mass electroplating of bulk goods, particularly for the electro-deposition of aluminum from an aprotic, oxygen-free and water-free, aluminum-organic electrolyte. The apparatus includes a plating tank for the acceptance of an electrolyte, a goods carrying dish being mounted to rotate on a incline axis in the plating tank and being immersed in the electrolyte, at least one disk-shaped anode dipping into the electrolyte and being aligned to be mainly parallel to a floor of the goods carrying dish and the goods carrying dish having at least one dog or ridge for spreading the goods on the floor of the carrying dish as the dish rotates.

In mass electroplating of bulk goods, the goods for galvanization must be held together so that during the galvanic processing, every individual part has electrical contact. On the other hand, the goods for galvanization should be spread out as far as possible so that the metal deposition can occur on the largest possible surfaces of the goods and an optimally uniform current density is guaranteed on all parts. These two demands must be fulfilled by the apparatus being used. A further significant condition for achieving faultless metal coatings with a uniform layer thickness is the adequate mixing of the goods for galvanizing during the galvanic processing. This mixing of the goods for galvanization is usually obtained by turning the goods vessel around a non-perpendicular axis so that dependent on the shape and wall friction, the individual parts are conveyed up to a greater or lesser distance on the goods tray and then in turn will roll back down or slide down the tray. However, despite this goods movement, a good electrical contact and a gentle treatment of the goods for galvanization should be guaranteed. Also, for quantitatively high-grade metal coatings, additional requirements or demands are made and these are requirements for an adequate electrolyte exchange, an optimally unimpeded current transfer between the anodes and the goods being galvanized and an adequate size and surface for the anode in relation to the surfaces of the goods being treated.

The simplest vessel for goods is the electroplating bell or a rotatable pot, which simultaneously serves as a plating tank. A mixing of the goods for galvanization is achieved in that the bell is mounted with its axis inclined relative to the perpendicular and is rotated around this axis. Since the anode is suspended into the bell, the anode surface itself is usually too small in comparison to the surface of the goods given an employment of profiled special anodes. This, however, then leads to low deposition rates and thus, to a lengthening of the electroplating duration and to an increase of the abrasion on the parts.

Electroplating drums are also frequently employed for mass electroplating and these drums in contrast to the bell only serves as vessels for the goods and are arranged in a plating tank. A mixing of the goods for galvanization is effected by turning the electroplating drum around a horizontal axis. Since the anodes are situated outside of the drum member, large anode surfaces can be obtained. On the other hand, a perforation must be introduced into the jacket of the drum member for the current passage between anodes and the goods for galvanization. However, for reasons of stability and in view of the size of the goods being plated or galvanized, the open cross section of these perforations, which is available for the current passage, is dimensioned so small that a considerable deterioration of the current passage will occur. This, however, then again leads to a low deposition rate and thus, to a lengthening of the electroplating duration or time and to an increase of the abrasion of the goods being treated.

German Patent No. 830,862 discloses an apparatus of the species initially cited wherein the goods are placed in a carrying dish which is provided with ribs on its inside. These ribs promote a uniform distribution of the bulk goods on the floor of the goods carrying dish. Given a rotation of the goods carrying dish, the ribs upwardly entrain the bulk goods so that a degree of spreading relative to the floor of the goods carrying dish is considerably enhanced by the ribs. Both the carrying dish for the goods as well as the vessel serving for the acceptance of the completely electroplated goods are pivotably seated around a common shaft that is seated above the plating tank so that both vessels can be brought into a mutual position to allow the bulk goods to be emptied from the goods carrying dish into an acceptance vessel which is then pivoted out of the electrolyte as the goods carrying dish is returned to the working position. The discharge of the completely electroplated goods, thus, involves a considerable outlay of time.

Aluminum deposited from an aprotic, oxygen-free and water-free, aluminum-organic electrolyte is distinguished by its ductility, low number of pores, corrosion resistance and capabilities of being anodically oxidized. Since, due to the reaction with atmospheric oxygen and atmospheric humidity, the access of air will cause a considerable reduction of the conductivity and useful life of these electrolytes, the electroplating must be undertaken in a means operating under the exclusion of air. So that the access of air can also be prevented during loading and unloading of this apparatus which operates under a protective atmosphere that excludes air, inward transfer and outward transfer locks are also required and these are fashioned as gas locks, as liquid locks or as combined gas/liquid locks. In mass aluminization utilizing the aprotic, oxygen-free and water-free, aluminum-organic electrolyte, the additional problem of preventing the access of air to the electrolyte in so far as possible is also added to the difficulties already set forth.

U.S. Pat. No. 4,360,409, which is based on German Pat. No. 30 23 129, discloses an apparatus for electrodeposition of aluminum from an aprotic, oxygen-free and water-free, aluminum-organic electrolyte, wherein the electroplating drum rotates about its horizontal axis and is arranged in a plating tank which can be closed gas tight. The electroplating drum is provided with perforations and is surrounded by two anodes which can be adjusted so that they form an opening for the bulk goods to be emptied through. The loading of the electroplating drum occurs via a conveyor means leading into the inside of the plating tank through a lock and this conveyor means ends above a closable opening of the electroplating drum so that the opening and closing of the electroplating drum is undertaken from the outside. A discharge vessel is fashioned as an outward transfer lock and serves the purpose of emptying the electroplating drum. This discharge vessel is arranged below the plating tank and is in communications therewith via a blockable, tubular connecting member.

In the known apparatus for electro-deposition of aluminum, the problem of preventing the access of air to the electrolyte has been satisfactorily resolved. As in other apparatus for drum electroplating, a deterioration of the current passage between the anodes arranged outside of the drum member and the goods being plated and situated in the inside of the drum can, however, also occur.

SUMMARY OF THE INVENTION

The object of the present invention is to improve an apparatus for the mass electroplating of bulk goods such that the discharge of the completely electroplated goods can be executed quickly and without little cost. The apparatus, moreover, should be designed so that it can be operated with a justifiable additional outlay with the exclusion of air and can be utilized for a mass aluminization by utilizing an aprotic, oxygen-free and water-free, aluminum-organic electrolyte.

These objects are obtained in an improvement in an apparatus for mass electroplating of bulk goods, particularly for electro-depositing of aluminum from an aprotic, oxygen-free and water-free, aluminum-organic electrolyte where the apparatus including a plating tank for the acceptance of the electrolyte, a goods carrying dish having an axis, means for mounting the dish for rotation in the plating tank with its axis inclined and the dish being immersed in electrolyte in the tank, at least one disk-shaped anode being immersed in the electrolyte and aligned at least mainly parallel to a floor of the carrying dish and the dish having at least one dog for spreading the goods on the floor of the carrying dish. The improvements are that at least one slide or discharge door is provided on a peripheral wall of the goods carrying dish to enable discharge of the goods therefrom.

The slide or door, which is provided in the peripheral wall of the goods carrying dish, can, for example, be pulled up via an externally arranged actuation element so that a particularly simple and fast discharge of the completely electroplated goods will occur. Given a suitable slanted position of the goods carrying dish, no additional measures are required for the discharge of the goods. An automatic emptying of the goods from the carrying dish occurs given an opening of the slide or discharge door when the door is in its lowest position of its movement or orbit.

It has proven advantageous for spreading the goods when a dog is formed by a plurality of ribs emerging from the floor and extending up to the upper edge of the goods carrying dish. Such ribs can then be arranged in the configuration which, for example, form triangular, quadratic, rectangular, circular or honeycombed regions on the floor of the goods carrying dish. The goods are then spread in each of these regions in a way similar to that in the traditional goods carrying dish, but the degree of spreading is considerably increased relative to the floor area of the goods carrying dish. In addition to such closed regions, the regions or zones which are in communication with one another in the manner of a labyrinth can also be formed by the ribs.

The spreading of the goods can be further improved when the dog is formed by a plurality of ribs extending in a radial direction. In particular, the goods carrying dish can then also be subdivided into a plurality of closed sectors by the ribs. This has the advantage that a separate mixing of the goods then occurs in every sector and the overall mixing degree is improved.

Given a goods carrying dish subdivided into individual sectors, a slide or discharge door can then be arranged for each and every sector. In order to simplify their actuation, a common actuating element preferably secured to the plating tank in the lower region of the travel for the goods carrying dish is then allocated to these slides or doors.

The dog can also be formed by a helically proceeding track wherein the helical track greatly promotes the spreading and mixing of the goods. The track can be formed in a particularly simple way by a profile introduced into the floor of the goods carrying dish. Particularly, the entrainment of the goods into the more highly placed regions of the goods carrying dish can then be further improved with the profile exhibiting a saw-toothed cross section.

In order to improve the electrolyte exchange, the floor of the goods carrying dish can also be provided with perforations. In this case, an auxiliary electrode aligned parallel to the floor at a distance therefrom can also be provided below the floor. As a result of this additional auxiliary electrode, the anode surface is further enlarged so that especially high deposition rates can be achieved.

In accordance with the particulary preferred development of the invention, the goods carrying dish has an electrically insulation surface either because it is composed of an electrically insulating material or is covered by an electrically insulating layer. To provide cathodic contacting of the goods, contact elements are arranged on the floor of the goods carrying dish. As a result of this structure, an undesired metal deposition on the goods carrying dish is avoided and the contact elements arranged under the goods in the floor guarantee an adequate uniform current acceptance over the overall effective goods surface. Metal deposition onto the contact elements fashioned, for example, as button contacts are at least largely removed in turn by the motion of goods and the abrasion connected therewith.

It has proven particularly beneficial for a good mixing of the goods when the angle of inclination of the axis of the goods carrying dish relative to a horizontal amounts to about 30° to 38°. When the angle of inclination of the axis of the goods carrying dish relative to the horizontal is adjustable, then a particularly good adaptability to the demand of the respective goods being galvanized is enabled in view of the spreading and mixing. Preferably, the angle of inclination of the axis is then variable via the oblique positioning of the overall plating tank. This thereby takes into consideration that given an adjustment of the axis, the parallel alignment of the anode to the floor of the goods carrying dish should be preserved. With an oblique positioning of the overall plating tank, a synchronized adjustment of the goods carrying dish and anode can be guaranteed in a particularly simple way. For a simple adjustment of its oblique position, the plating tank is expediently pivotably mounted on a frame.

The apparatus of the present invention can be utilized with relatively little additional outlay for the mass aluminization upon employment of aprotic, oxygen-free and water-free, aluminum-organic electrolyte. This is achieved in that the plating tank can be closed gas tight and in that locks are provided for the introduction and the discharge of the goods. The plating tank is then preferably provided with a cover arranged in the region of the anode so that the anode is easily accessible when the cover is removed and the anode can be unproblematically replaced when necessary.

DESCRIPTION OF THE PREFERRED EMBODIMENTS

Figure 1:
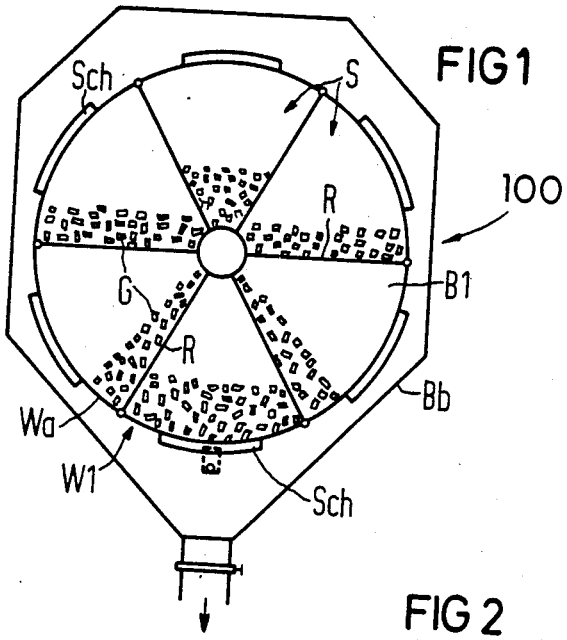
FIG. 1 is a schematic plan view of an apparatus of the mass aluminization for bulk goods with portions removed for purposes of illustration.
Figure 2:
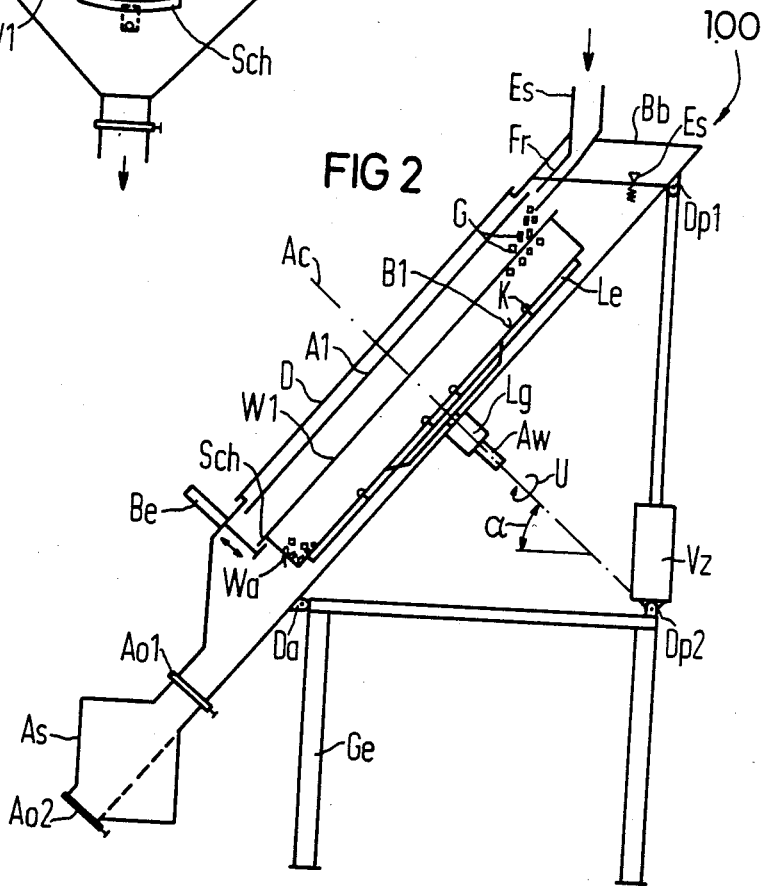
FIG. 2 is a longitudinal schematic cross sectional view with portions in elevation for purposes of illustration of the apparatus of FIG. 1.

The principles of the present invention are particularly useful in an apparatus for the mass aluminization of goods G, which apparatus is generally indicated at 100 in FIGS. 1 and 2. The apparatus 100 includes a plating tank Bb, which is mounted obliquely on a frame Ge and is closed gas tight with the assistance of a cover D. The tank Bb receives an aprotic, oxygen-free and water-free, aluminum-organic electrolyte with the electrolyte level being indicated at Esp and the region of the tank above the electrolyte level Esp being charge with an inert gas, such as, for example, nitrogen.

Bulk goods G, which are to be aluminum plated, and, for example, comprise screws, nuts, bolts, spacer bushings and the like, are introduced into the plating tank Bb through an admission lock Es (FIG. 2) which is conventional and has a slanting downpipe Fr connected thereto. The lock Es will includes means (not illustrated) to form a gas lock, a liquid lock or a combination gas/liquid lock. The slanting downpipe Fr is positioned to discharge into a sector S of a goods carrying dish or carrier dish W1, which has an axis Ac and is mounted for rotation in the tank with the dish being completely immersed below the electrolyte level Esp. The goods carrying dish W1 comprises the shape of an extremely flat circular cylinder has a floor B1 and has a peripheral wall Wa. On the basis of a total of six radial ribs R arranged in uniform division, the goods carrying dish W1 is sub-divided into six identical sectors S, which has already been mentioned, are successively loaded from above with the bulk goods G to be aluminum plated. The successive loading of the individual sectors is enabled in that the dish W1 is turned about its axis Ac, which is inclined relative to the horizontal at an angle $\alpha$ and is illustrated as turned clockwise as indicated by the arrow U (FIG. 2). The corresponding drive shaft Aw of the goods carrying dish W1 is rigidly connected to the floor B1 and is conducted gas tight and liquid tight through a wall of the plating tank Bb. This is accomplished by being received in a bearing Lp applied to the wall of the plating tank Bb and the shaft Aw extends through the bearing to the outside. A drive allocated to the drive shaft Aw is not shown in the drawings.

A plurality of contact elements K are arranged on the floor B1 of the goods carrying dish W1, which is composed of enameled sheet steel. The contact elements K are fashioned as button contacts and the current feed thereto occurs via a line Le and a slip ring (not shown in the drawings) arranged outside of the plating tank. The ribs R acting as dogs spread the goods G on the floor B1 in either one layer or two layers and these goods G are then cathodically contacted via the contacts K. A dish-shaped anode A1 is arranged at a slight distance above the floor B1 and parallel thereto and thus, the anode A1 is parallel to the spread of the goods G as shown in a purely schematic fashion in FIG. 2. The insulated fastening of this anode A1, which is composed of pure aluminum and formed of a plurality of segments, namely the fastening thereof in the plating tank Bb, is conventional and not illustrated in FIG. 2. It may be seen, however, that the anode A1 can be easily replaced when the cover D is removed.

During the aluminum electro-depositing, the goods carrying dish W1 is turned about its inclined axis Ac in the direction of the arrow U so that the goods G are separately mixed in each sector S. As a consequence of the unimpeded passage of the electroplating current between the anode A1 and surface of the goods, high deposition rates can be achieved so that the goods G can be ready for discharge after a relatively short plating time. For this purpose, the peripheral wall Wa is provided with a slide or door Sch with one door or slide allocated to each individual sector S. The door or slide is pulled up via a pneumatic or hydraulic actuation element Be, which is secured to the plating tank Bb in the lower region of the dish W1. In this way, the sector S, respectively situated at the lowest point in the tank, can be emptied.

The goods G, as they empty from the sector S, proceed into the lower regions of the plating tank Bb, which is fashioned funnel-shaped and is followed by a first blocking element Ao1, a discharge tank acting as an outward transfer lock As and by a second blocking element Ao2. The outward transfer of the goods G is accomplished with the following steps. First, the first blocking element Ao1 is opened so that the goods G and a part of the electrolyte enter into an outward transfer lock As, and then the first blocking element is closed. Then, the electrolyte is pumped from the transfer lock As back into the plating tank Bb and subsequently, the transfer lock As is filled with toluol from a supply reservoir for rinsing the goods G. After rinsing the goods, the toluol is pumped from the transfer lock As back into the supply reservoir, and then the second or outer blocking element Ao2 is opened to enable emptying the transfer lock As.

As illustrated, the plating tank Bb is obliquely arranged on a frame Ge so that the oblique position can be changed by pivoting the overall plating tank Bb. For this purpose, the lower region of the plating tank Bb is hinged to the frame Ge at a rotational axis Da whereas a pneumatic or hydralically actuatable adjustment cylinder Vz is hinged to the upper region of the plating tank Bb by a first pivot point Dp1 and is hinged to the frame Ge at a second pivot point Dp2. In this way, the oblique position of the plating tank Bb and, thus, the angle of inclination of the axis Ac of the goods carrying dish W1 relative to the horizontal can be set by the actuation cylinder Vz.

The following dimensions and operating values are examples for the apparatus described in FIGS. 1 and 2.

Diameter of the goods carrying dish W1: 3.0 m
Bulk weight of the goods G: about 300 kg
Anodic current density: 1.0 A/dm$^2$
Cathodic current density: 0.5–1.0 A/dm$^2$
Angle of inclination $\alpha$: 30°–38°
Speed of rotation for the carrying dish W1: 2–12 rpm The speed and the angle of inclination $\alpha$ can be adapted to the goods G which are to be aluminum plated so that the spread of the goods G shown in FIG. 1 roughly occurs. It may be seen that there are zones that are not covered by goods G in any position of the goods carrying dish W1 and these zones exist in the middle region of the sectors S. In order to prevent an undesirable aluminum deposition, no contact elements K are arranged in these zones.

An apparatus corresponding to the examplary embodiment of the FIGS. 1 and 2 was constructed in a model scale and was tested in combination with a comparably equipped apparatus comprising an electroplating drum. Deposition rates higher by a factor of 2 through 3 were capable of being achieved with the apparatus having the goods carrying dish. In addition, the layer thickness of the metal coatings, moreover, was also more uniform than obtained in an apparatus equipped with an electroplating drum.

Figure 3:
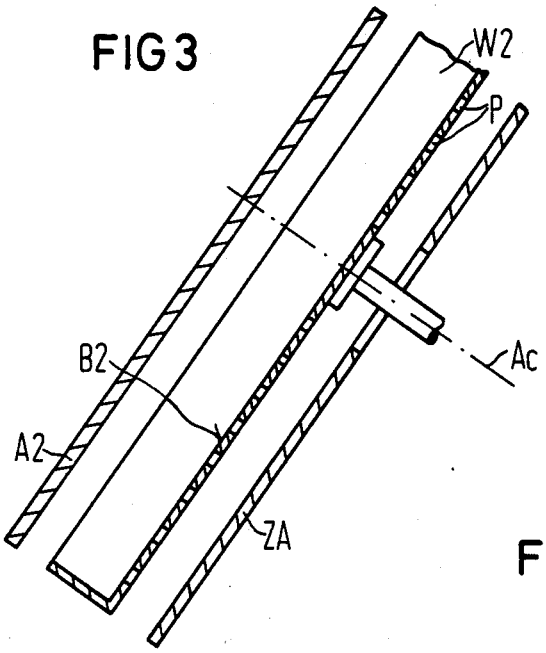
FIG. 3 is a partial cross sectional view of a modification of the carrier dish of FIG. 2 with an auxiliary anode.

A modification of the goods carrying dish is shown by a dish W2 in FIG. 3 which has the slide or door Szh and is used with an upper electrode A2. The dogs, which can again be a ribs, are not shown. A plurality of perforations P are introduced into the floor B2 of the goods carrying dish W2 so that the electrolyte exchange is capable of being further improved by means of these perforations. In addition, an auxiliary anode ZA is arranged at a distance under the floor B2 and is aligned parallel to the floor B2. This auxiliary anode ZA is composed of pure aluminum like the anode A2 and is constructed of a plurality of joined together segments. Although the current passage is limited here by the perforations P as in the case of an electroplating drum, a further increase of the deposition rate is obtained by the arrangement of the auxiliary anode ZA. Multiple arrangements of goods carrying dishes W2 rotatable in common stack are also conceivable whereby the auxiliary anodes ZA then simultaneously serve as a principle anode of the next lower goods carrying dish W2 in the stack.

Figure 4:
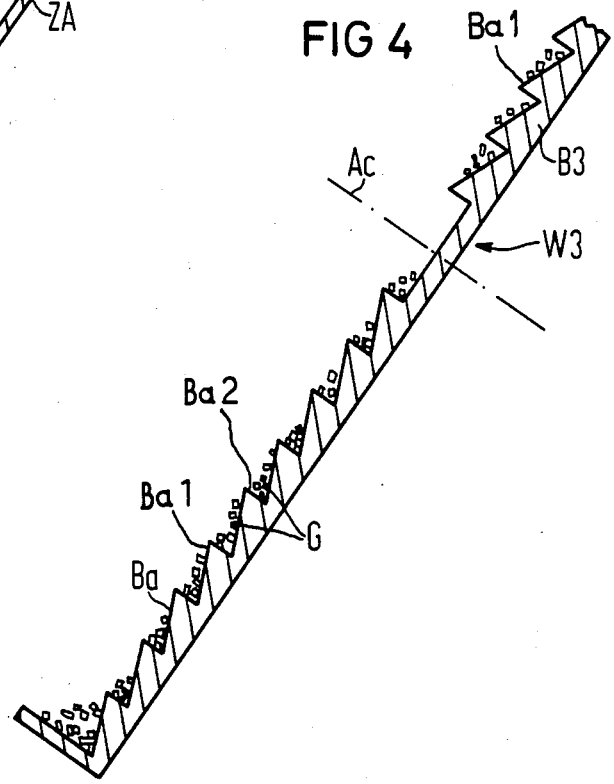
FIG. 4 is a partial cross sectional view illustrating a modification of a dog formed in the floor of the carrier dish of the device.

A second modification is shown by a carrying dish W3 as illustrated in FIG. 4. The dish W3 has a floor B3 which is provided with a profile having a saw-toothed cross section which forms a track Ba proceeding in the form of a helix. This helical track Ba forms a dog which has a steep surface Ba2 merging with a inclined surface Ba1 and which dog, due to the rotation of the goods carrying dish W3, in turn forms a conveying means which will transport the goods G from the lower region into the upper region of the goods carrying dish. In the upper region, the goods will then slide down over the inclined edges or surfaces Ba1 so that an extremely good mixing will occur. From a number of trial tests, the angle of inclination $\alpha$ and the rotary speed can be set so that goods G will be spread nearly completely over the entire floor area of the goods carrying dish W3 and provide an extremely intense mixing. A single slide or door Sch in the peripheral wall of the dish W3 is sufficient for the discharge of the completed electroplated goods for this embodiment. This slide Sch is opened, when it is in the lowermost position of its orbit. Upon discharge, the angle of inclination $\alpha$ can then also be reduced so that the goods automatically fall out of the goods carrying dish W3.

Although various minor modifications may be suggested by those versed in the art, it should be understood that we wish to embody with the scope of the patent granted hereon, all such modifications as reasonably and properly come within the scope of our contribution to the art.

We claim:

1. In an apparatus for the mass electroplating of bulk goods, particularly for electro-deposition of aluminum from an aprotic, oxygen-free and water-free, aluminum-organic electrolyte, said apparatus including a plating tank for the acceptance of an electrolyte, a goods carrying dish having an axis, a peripheral wall and a floor; means for mounting the goods carrying dish in the tank with its axis inclined to a horizontal plane, with the dish being immersed in electrolyte and for rotation of the dish around the inclined axis; and at least one disk-shaped anode immersed in the electrolyte and being aligned at least mainly parallel to the floor of the goods carrying dish, said carrying dish having at least one dog for spreading the bulk goods on the floor of the carrying dish, the improvements comprising at least one sliding door being provided in the peripheral wall of the goods carrying dish to enable discharge of the goods therefrom.

2. In an apparatus according to claim 1, wherein the dog is formed by a plurality of ribs extending from the floor and up to the upper edge of the goods carrying dish.

3. In an apparatus according to claim 2, wherein the plurality of ribs extend in an axial direction.

4. In an apparatus according to claim 3, wherein the ribs are positioned to subdivide the carrying dish into a plurality of closed sectors.

5. In an apparatus according to claim 4, wherein each of the sectors is provided with a sliding door in the peripheral wall.

6. In an apparatus according to claim 5, wherein a common actuating element is mounted in the plating tank adjacent the lower peripheral wall of the goods carrying dish, said actuating element operating to open each of the sliding doors as they are rotated to a lowermost position.

7. In an apparatus according to claim 5, wherein the floor of the goods carrying dish is provided with perforations.

8. In an apparatus according to claim 7, which includes an auxiliary anode being arranged beneath the floor at a distance from and parallel to the floor of the dish.

9. In an apparatus according to claim 5, wherein the goods carrying dish has an electrically insulating surface and is provided with a plurality of contact elements which are arranged on the floor of the goods carrying dish for cathodic contacting of the goods received in said dish.

10. In an apparatus according to claim 5, wherein the plating tank is closed gas tight and is provided with locks for the introduction and discharge of goods therefrom.

11. In an apparatus according to claim 1, wherein the dog is formed by a helically extending track.

12. In an apparatus according to claim 11, wherein the track is formed by a profile formed in a floor of the goods carrying dish.

13. In an apparatus according to claim 12, wherein the profile has a saw-toothed cross section.

14. In an apparatus according to claim 11, wherein the floor of the goods carrying dish is provided with perforations.

15. In an apparatus according to claim 11, wherein the plating tank can be closed gas tight and is provided with locks for the introduction and discharge of goods therefrom.

16. In an apparatus according to claim 1, wherein the floor of the goods carrying dish is provided with perforations.

17. In an apparatus according to claim 16, which includes an auxiliary anode being arranged under the floor at a distance to extend parallel to the floor.

18. In an apparatus according to claim 1, wherein the goods carrying dish is composed of an electrically insulating material and is provided with contact elements arranged on the floor of the carrying dish for cathodic contacting of the goods.

19. In an apparatus according to claim 1, wherein the goods carrying dish is covered with an electrically insulating layer and is provided with contact elements arranged on the floor of the goods carrying dish for cathodically contacting the goods carried thereby.

20. In an apparatus according to claim 1, wherein the angle of inclination of the axis of the goods carrying dish amounts to about 30°–38° relative to a horizontal plane.

21. In an apparatus according to claim 1, wherein the angle of inclination of the axis of the goods carrying dish relative to the horizontal plane is variable.

22. In an apparatus according to claim 21, wherein the angle of inclination of the axis is adjustable via an oblique positioning of the overall plating tank.

23. In an apparatus according to claim 22, wherein the plating tank is pivotably arranged on a frame.

24. In an apparatus according to claim 1, wherein the plating tank can be closed gas tight and has locks for the introduction and discharge of goods therefrom.

25. In an apparatus according to claim 24, wherein the plating tank is provided with a cover arranged in the region of the anode.

* * * * *